US006578744B2

(12) United States Patent
Hierzer et al.

(10) Patent No.: US 6,578,744 B2
(45) Date of Patent: Jun. 17, 2003

(54) WATERTIGHT TUBE CLOSURE

(75) Inventors: Valentin Hierzer, Arlington Heights, IL (US); Rick Gaiser, Spring Grove, IL (US); Robert Simpson, Grayslake, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/814,358

(22) Filed: Mar. 22, 2001

(65) Prior Publication Data

US 2002/0134795 A1 Sep. 26, 2002

(51) Int. Cl.[7] ..... B65D 5/72
(52) U.S. Cl. ..... 222/556; 222/568; 215/237
(58) Field of Search ..... 222/568, 556, 222/153.14; 215/237

(56) References Cited

U.S. PATENT DOCUMENTS

| | | | | |
|---|---|---|---|---|
| RE29,850 E | | 11/1978 | Labarre | |
| 4,420,089 A | | 12/1983 | Walker et al. | |
| 4,545,495 A | | 10/1985 | Kinsley | |
| 4,591,078 A | | 5/1986 | Weissman | |
| 4,635,823 A | | 1/1987 | Stull | |
| 4,638,916 A | | 1/1987 | Beck et al. | |
| 4,699,283 A | * | 10/1987 | Dubach | 215/237 |
| 4,801,054 A | | 1/1989 | Nycz | |
| 5,779,110 A | | 7/1998 | Brown et al. | |
| 5,785,193 A | * | 7/1998 | Kobayashi et al. | 215/237 |
| 5,860,543 A | * | 1/1999 | Decelles | 222/256 |

FOREIGN PATENT DOCUMENTS

| | | |
|---|---|---|
| EP | 0 199 673 A2 | 4/1986 |
| EP | 0 199 673 B1 | 9/1986 |
| EP | 0 447 357 B1 | 2/1991 |
| EP | 0 461 067 A1 | 5/1991 |
| WO | WO 92/13775 | 8/1992 |
| WO | WO 99/11530 | 3/1999 |
| WO | WO 99/38781 | 8/1999 |

* cited by examiner

*Primary Examiner*—Philippe Derakshani
(74) *Attorney, Agent, or Firm*—Knoble & Yoshida, LLC

(57) ABSTRACT

A dispensing closure for a container that contains a flowable product such as a bath gel includes a body member that is constructed and arranged to be mounted to the container, that includes a dispensing opening and a further includes an upper deck portion, a lid member that is hinged to the body member and that includes a cover portion and at least one downwardly depending sidewall, and a snap fit mechanism for releasably locking the lid member to the body member. The downwardly depending sidewall portion of the lid member and the upper deck portion of the body member are advantageously configured to form therebetween a watertight seal when the lid member is in the closed position.

20 Claims, 2 Drawing Sheets

WATERTIGHT TUBE CLOSURE

BACKGROUND OF THE INVENTION

1. Field of the Invention

This invention relates generally to packaging technology for flowable products such as bath gels, skin care creams and similar materials, which could include comestible products such as ketchup and mustard as well. More specifically, this invention relates to an improved watertight closure for such flowable products, which has particular utility for use with soft plastic tubelike containers.

2. Description of the Related Technology

A large consumer market exists for flowable personal care products such as bath gels and skin care creams. One of the preferred configurations for packaging such flowable products for delivery to the consumer includes a combination of a soft, squeezable plastic tubelike container that has a molded finish portion that is externally threaded and a snap type closure that is fitted one to the molded finish portion of the container. Typically, the snap type closure includes a body portion to which the container is attached, a hinge, and a lid that is mounted to the body portion by the hinge. A dispensing opening is ordinarily defined within the body portion and the lid includes a complementary member that both plugs the dispensing opening and releasably locks the lid member to the body portion when the lid member is closed and the product is not being used.

Conventional snap type closures tend to be fairly effective in preventing the flowable product from escaping the container when closed, but less viscous liquids such as water can often seep into or escape from such closures, causing unwanted results. For example, a product such as bath gel, which is often kept within a wet shower or bathtub area by consumers is susceptible to having water trapped within the container after use, and also to having water seep between the closure lid and the closure body, even when the closure is closed. Water that becomes trapped between the lid and the body portion of the closure can stagnate and lead over time to the growth of bacteria, mold or fungus within the closure. This of course is undesirable and unhygienic.

The problems described above can generally be attributed to the failure of conventional snap type closures to effectively provide a watertight seal between the respective outer peripheries of the lid and the body portion. This is a long-standing problem that has been difficult to solve, for a number of reasons, the foremost of which is the need for certain irregularities to be molded into the body portion and/or the lid in order to form the hinge and provide gripping structure with which the consumer will open the closure.

A long and unfilled need exists for an improved packaging assembly and closure for flowable products that reduces or eliminates the problems that are created by poor sealing between the lid and the body portion of the closure.

SUMMARY OF THE INVENTION

Accordingly, it is an object of the invention to provide an improved packaging assembly and closure for flowable products that reduces or eliminates the problems that are created by poor sealing between the lid and the body portion of the closure.

In order to achieve the above and other objects of the invention, a dispensing closure for a container that contains a flowable product includes, according to a first aspect of the invention, a body member having an upper deck portion and a downwardly depending skirt portion, the downwardly depending skirt portion having structure defined on an interior surface thereof that is constructed and arranged to be mounted to a finish of a container, the body member further having a dispensing opening defined in the upper deck portion; a lid member hingedly mounted to the body member by a hinge, the lid member comprising a cover portion and at least one downwardly depending sidewall portion; releasable lock structure for releasably locking the lid member in a closed position with respect to the body member; and wherein the downwardly depending sidewall portion of the lid member and the upper deck portion of the body member are configured to form therebetween a watertight seal when the lid member is in the closed position with respect to the body member.

According to a second aspect of the invention, a packaging assembly for a flowable product includes a container having an interior space defined therein for holding a flowable product and a finish portion; a body member having an upper deck portion and a downwardly depending skirt portion, the downwardly depending skirt portion having structure defined on an interior surface thereof that is mounted to the finish portion of said container, the body member further having a dispensing opening defined in the upper deck portion; a lid member hingedly mounted to the body member by a hinge, the lid member comprising a cover portion and at least one downwardly depending sidewall portion; releasable lock structure for releasably locking the lid member in a closed position with respect to the body member; and wherein the downwardly depending sidewall portion of the lid member and the upper deck portion of the body member are configured to form therebetween a watertight seal when the lid member is in the closed position with respect to the body member.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
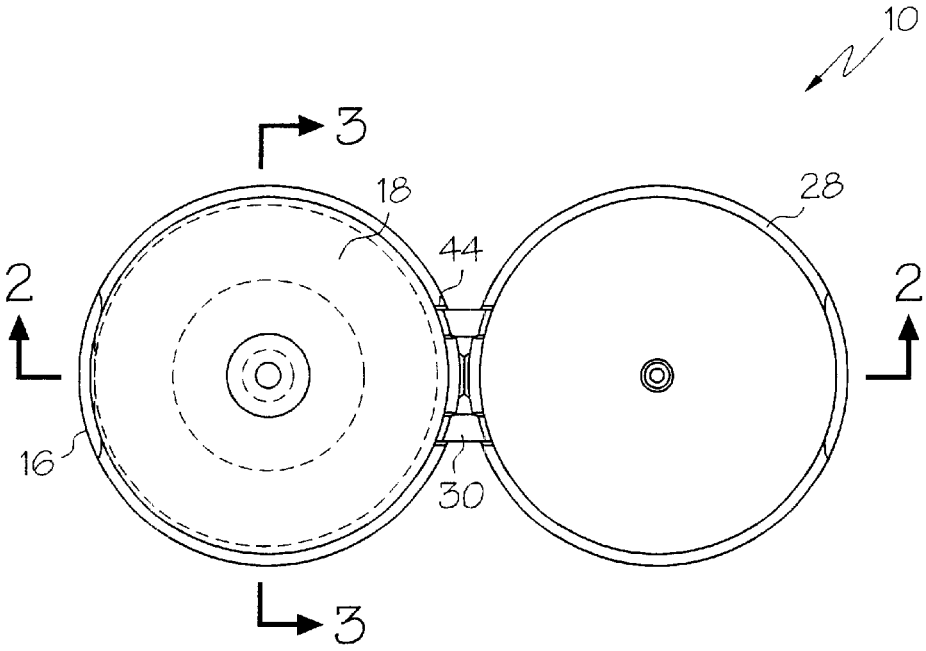
FIG. 1 is a top plan view of a dispensing closure that is constructed according to a preferred embodiment of the invention.
Figure 7:
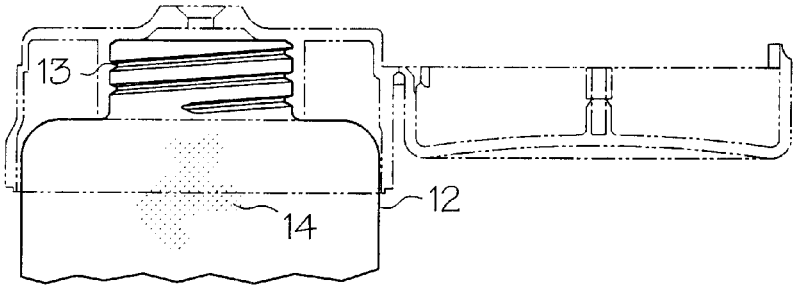
FIG. 7 is a fragmentary cross-sectional view depicting a portion of a packaging assembly including the closure that is depicted in FIGS. 1–6.

Referring now to the drawings, wherein like reference numerals designate corresponding structure throughout the views, and referring in particular to FIG. 1, a dispensing closure 10 that is constructed according to a preferred embodiment of the invention is, as is best shown in FIG. 7, constructed and arranged to be mounted to a finish 13 of a container 12 for a flowable product 14. The combination of the closure 10 and the container 12 form a packaging assembly according to the invention, and the container 12 is most preferably a tube type container such as those that are typically used to package products such as bath gels and skin care creams.

Referring again to FIG. 1, dispensing closure 10 preferably includes a body member 16 that has an upper deck portion 18 and a downwardly depending skirt portion 20 that has mounting structure 22 thereon for mounting the closure to the finish 13 of the container 12. In the preferred embodiment, mounting structure 22 is embodied as a plurality of threads 24 that are defined on an interior surface of a downwardly depending annular projection that is unitary with the upper deck portion 18 of body member 16. Body member 16 further includes a dispensing opening 26 defined therein for dispensing the flowable product 14 from the container 12.

As is also shown in FIG. 1, dispensing closure 10 further includes a lid member 28 that is hingedly mounted to the body member 16 by means of a hinge 30. Lid member 28 includes a cover portion 32 and a downwardly depending sidewall portion 34, which in the preferred embodiment is generally cylindrical in shape.

In the preferred embodiment, body member 16, lid member 28 and hinge 30 are unitary, being formed of a common, continuous piece of plastic material that is preferably polypropylene but that could alternatively be any one of a number of different types of plastic material, such as high-density polyethylene. Hinge 30 is of conventional construction for closures of this general type.

Figure 2:
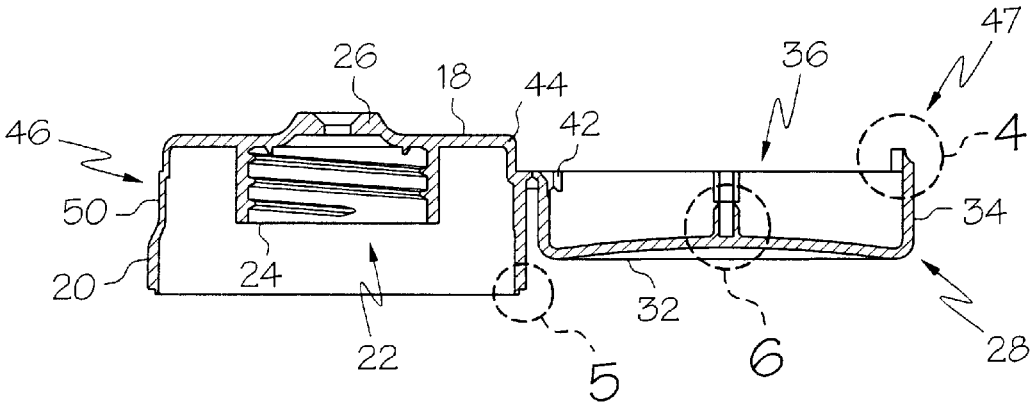
FIG. 2 is a cross-sectional view taken along lines 2—2 in FIG. 1.
Figure 6:
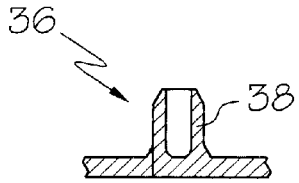
FIG. 6 is a close-up view of the area indicated by the circle marked 6—6 in FIG. 1.

As may best be seen in FIGS. 2 and 6, releasable locking structure 36 is provided for releasably locking the lid member 28 in a closed position with respect to the body member 16. In the preferred embodiment, the structure is embodied as a plug member 38 that is slightly larger in diameter at its distal end then it is at its base end. Accordingly, and as is conventional in closures of this general type, plug member 38 will be retained in the dispensing opening 26 when the closure 10 is closed in a snap fit type configuration.

Figure 3:
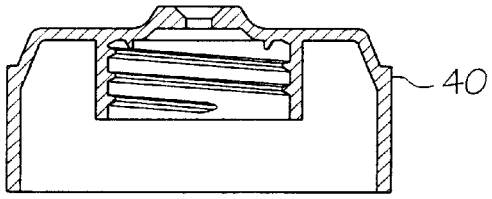
FIG. 3 is a cross-sectional view taken along lines 3—3 in FIG. 1.

According to one important aspect of the invention, the downwardly depending sidewall portion 34 of the lid member 28 and the upper deck portion 18 of the body member 16 are configured to form therebetween a watertight seal when the lid member 28 is in the closed position with respect to the body member 16. To achieve this end, the outer core 48 of the upper deck portion 18 is formed as an angled, annular surface 40 that can be described as having a truncated comical shape. Surface 40 is preferably angled at an angle a with respect to vertical, as is the shown in FIG. 3. The presence of this angled, annular surface 40 will, when the lower end of the downwardly depending sidewall portion 34 of the lid member 38 is pressed thereagainst, form a pressurized circular area of contact that will optimize sealing between the upper deck portion 18 of the body member 16 and the downwardly depending sidewall portion 34 of the lid member 28.

In addition, the downwardly depending sidewall portion 34 has a recess 42 defined therein for receiving or accommodating the geometry of the hinge 30, and the upper deck portion 18 of body member 16 includes a complimentary projection 44 that is complimentary in shape with the recess 42 so as to ensure a watertight seal in the area about the hinge 30 when the lid member 28 is in the closed position with respect to the body member 16. As may best be seen in FIG. 2, the upper deck portion 18 of the body member 16 has a substantially flat upper surface, and the projection 44 has an upper surface as well that is substantially flush with the upper surface of the upper deck portion 18. As may best be seen in FIG. 1, the projection 44 extends outwardly in a radial direction with respect to adjacent areas of the upper deck portion 18.

As is best shown in FIG. 2, the downwardly depending sidewall portion 34 of the lid member 28 is annular in shape and has an interior diameter. The upper deck portion 18 of the body member 16 is substantially circular in shape, except for the projection 44 described above, and has an outer diameter. In order to maintain a close, watertight seal, the interior diameter of the downwardly depending sidewall portion 34 is made so as to be substantially the same as the outer diameter of the upper deck portion 18. This close fit in conjunction with the resilience of the plastic material from which the closure 10 is preferably fabricated will ensure a watertight seal when the closure 10 is closed.

Figure 4:
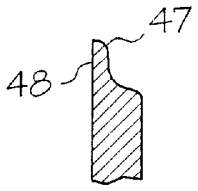
FIG. 4 is a close-up view of the area indicated by the circle marked 4—4 in FIG. 1.

As may best be seen in FIGS. 1, 2 and 4, the downwardly depending skirt portion 20 of the body member 16 has a thumb tab recess 46 defined therein, and the lid member 28 includes a thumb tab projection 47 which, as is best shown in FIG. 4, has a smooth inner surface 48. According to one advantageous feature of the invention, the thumb tab recess 46 is substantially complementary in shape to the thumb tab projection 47, so that a watertight seal is created in an area about the thumb tab projection 47 when the lid member 28 is in the closed position with respect to the body member 16. In this closed position, the smooth inner surface 48 of the thumb tab projection 47 will press tightly against a corresponding smooth outer surface 50 on the outer surface of the downwardly depending skirt portion 20 of the body member 16 that defines the thumb tab recess 46.

Figure 5:
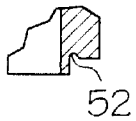
FIG. 5 is a close-up view of the area indicated by the circle marked 5—5 in FIG. 1.

According to another advantageous feature of the invention, the downwardly depending skirt portion 20 of the body member 16 includes an extension 52 at its lowermnost, distal end, as is best illustrated in FIG. 5. Extension 52, which in the preferred embodiment forms a narrow annular ring at the bottom of the body member 16, has a thickness that is less than a thickness of an adjacent portion of the downwardly depending skirt portion 20. The purpose of extension 52 is to deform against a surface of the container 12 when the closure 10 is mounted to the container 12, thereby forming a seal between the contacting surface of the container 12 and the closure 10. In the preferred embodiment, the container 12 is a squeeze type tubular container that is made of a soft plastic, and preferably a plastic that is softer than the material from which the closure 10 is fabricated. When the projection 52 is pressed against the contacting surface of the container 12, both the projection 52 and the contacting surface will be expected to deflect to some degree, forming in effect a secondary seal between the closure 10 and the container 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensing closure for a container that contains a flowable product, comprising:

a body member having an upper deck portion and a downwardly depending skirt portion, said downwardly depending skirt portion having structure defined on an interior surface thereof that is constructed and arranged to be mounted to a finish of a container, said body member further having a dispensing opening defined in said upper deck portion;

a lid member hingedly mounted to said body member by a hinge, said lid member comprising a cover portion and at least one downwardly depending sidewall portion;

releasable lock means for releasably locking said lid member in a closed position with respect to said body member;

and wherein said downwardly depending sidewall portion of said lid member and said upper deck portion of said body member are configured to form therebetween a watertight seal when said lid member is in said closed position with respect to said body member.

2. A dispensing closure according to claim 1, wherein said downwardly depending sidewall portion of said lid member has a recess defined therein for receiving said hinge, and wherein said upper deck portion of said body member includes a projection that is complementary in shape with said recess in said sidewall portion of said lid member, whereby a watertight seal is maintained in an area about said hinge when said lid member is in said closed position with respect to said body member.

3. A dispensing closure according to claim 2, wherein said upper deck portion of said body member has a substantially flat upper surface, and wherein said projection has an upper surface that is substantially flush with said upper surface of said upper deck portion.

4. A dispensing closure according to claim 2, wherein said projection extends outwardly in a radial direction with respect to adjacent areas of said upper deck portion.

5. A dispensing closure according to claim 1, wherein said downwardly depending sidewall portion of said lid member is annular in shape and has an interior diameter, and wherein said upper deck portion of said body member is substantially circular in shape and has an outer diameter, and wherein said interior diameter of said sidewall portion is substantially the same as said outer diameter of said upper deck portion.

6. A dispensing closure according to claim 1, wherein said downwardly depending skirt portion of said body member has a thumb tab recess defined therein, and wherein said lid member includes a thumb tab projection on said downwardly depending sidewall portion, and wherein said thumb tab recess is substantially complementary in shape to said thumb tab projection, whereby a watertight seal is maintained in an area about said thumb tab projection when said lid member is in said closed position with respect to said body member.

7. A dispensing closure according to claim 1, wherein said downwardly depending skirt portion of said body member comprises an extension at its lowermost distal end, said extension having a thickness that is less than a thickness of an adjacent portion of said downwardly depending skirt portion.

8. A dispensing closure according to claim 7, wherein said extension is constructed and arranged to form a seal against a surface of a container to which said dispensing closure may be mounted.

9. A dispensing closure according to claim 7, wherein said extension is constructed and arranged to deform against a surface of a container to which said dispensing closure is mounted, thereby forming a seal between said dispensing closure and the container.

10. A dispensing closure according to claim 1, wherein said body member, said lid member and said hinge are unitary.

11. A packaging assembly for a flowable product, comprising:

a container having an interior space defined therein for holding a flowable product and a finish portion;

a body member having an upper deck portion and a downwardly depending skirt portion, said downwardly depending skirt portion having structure defined on an interior surface thereof that is mounted to said finish portion of said container, said body member further having a dispensing opening defined in said upper deck portion;

a lid member hingedly mounted to said body member by a hinge, said lid member comprising a cover portion and at least one downwardly depending sidewall portion;

releasable lock means for releasably locking said lid member in a closed position with respect to said body member;

and wherein said downwardly depending sidewall portion of said lid member and said upper deck portion of said body member are configured to form therebetween a watertight seal when said lid member is in said closed position with respect to said body member.

12. A packaging assembly according to claim 11, wherein said downwardly depending sidewall portion of said lid member has a recess defined therein for receiving said hinge, and wherein said upper deck portion of said body member includes a projection that is complementary in shape with said recess in said sidewall portion of said lid member, whereby a watertight seal is maintained in an area about said hinge when said lid member is in said closed position with respect to said body member.

13. A packaging assembly according to claim 12, wherein said upper deck portion of said body member has a substantially flat upper surface, and wherein said projection has an upper surface that is substantially flush with said upper surface of said upper deck portion.

14. A packaging assembly according to claim 12, wherein said projection extends outwardly in a radial direction with respect to adjacent areas of said upper deck portion.

15. A packaging assembly according to claim 11 , wherein said downwardly depending sidewall portion of said lid member is annular in shape and has an interior diameter, and wherein said upper deck portion of said body member is substantially circular in shape and has an outer diameter, and wherein said interior diameter of said sidewall portion is substantially the same as said outer diameter of said upper deck portion.

16. A packaging assembly according to claim 11, wherein said downwardly depending skirt portion of said body member has a thumb tab recess defined therein, and wherein said lid member includes a thumb tab projection on said downwardly depending sidewall portion, and wherein said thumb tab recess is substantially complementary in shape to said thumb tab projection, whereby a watertight seal is maintained in an area about said thumb tab projection when said lid member is in said closed position with respect to said body member.

17. A packaging assembly according to claim 11, wherein said downwardly depending skirt portion of said body member comprises an extension at its lowermost distal end, said extension having a thickness that is less than a thickness of an adjacent portion of said downwardly depending skirt portion.

18. A packaging assembly according to claim 17, wherein said extension is constructed and arranged to form a seal against a surface of a container to which said packaging assembly may be mounted.

19. A packaging assembly according to claim 17, wherein said extension is constructed and arranged to deform against a surface of a container to which said packaging assembly is mounted, thereby forming a seal between said dispensing closure and the container.

20. A packaging assembly according to claim 11, wherein said body member, said lid member and said hinge are unitary.

* * * * *